US008872053B2

(12) United States Patent
Wittenberg

(10) Patent No.: US 8,872,053 B2
(45) Date of Patent: Oct. 28, 2014

(54) SLIDING BUTTON WITH ROTATING SHAFT

(75) Inventor: Michael B. Wittenberg, Mountain View, CA (US)

(73) Assignee: Apple Inc., Cupertino, CA (US)

( * ) Notice: Subject to any disclaimer, the term of this patent is extended or adjusted under 35 U.S.C. 154(b) by 585 days.

(21) Appl. No.: 12/789,387

(22) Filed: May 27, 2010

(65) Prior Publication Data

US 2011/0290630 A1 Dec. 1, 2011

(51) Int. Cl.

| | |
|---|---|
| ***H01H 15/10*** | (2006.01) |
| *H01H 15/06* | (2006.01) |
| *H01H 1/58* | (2006.01) |
| *H01H 1/40* | (2006.01) |
| *H01H 3/50* | (2006.01) |

(52) U.S. Cl.

CPC ..... *H01H 15/102* (2013.01); *H01H 15/06* (2013.01); *H01H 1/5805* (2013.01); *H01H 1/40* (2013.01); *H01H 3/50* (2013.01)

USPC ..... 200/548; 200/549; 200/329

(58) Field of Classification Search

USPC ..... 200/530, 531, 547–551, 536, 252, 291, 200/17 R

See application file for complete search history.

(56) References Cited

U.S. PATENT DOCUMENTS

| | | | | |
|---|---|---|---|---|
| 4,709,310 | A | 11/1987 | Ohashi | |
| 5,596,181 | A * | 1/1997 | Bach et al. | 200/8 R |
| 6,373,006 | B1 * | 4/2002 | Toki | 200/61.7 |
| 7,208,692 | B2 * | 4/2007 | Yamaguchi | 200/547 |
| 7,241,188 | B2 | 7/2007 | Lin et al. | |
| 2007/0114117 | A1 | 5/2007 | Hull et al. | |

* cited by examiner

*Primary Examiner* — Amy Cohen Johnson
*Assistant Examiner* — Marina Fishman
(74) *Attorney, Agent, or Firm* — Brownstein Hyatt Farber Schreck, LLP

(57) ABSTRACT

An electronic device may have a housing with an opening. A button may be formed within the electronic device. The button may have a button member that is actuated by a user. The button member may translate within an opening in the electronic device housing when actuated by a user. The button may have a shaft that is coupled to the button member by a coupling mechanism. When the button member is laterally translated within the opening, the coupling mechanism may rotate the shaft about its longitudinal axis. The button may be provided with detents using a detent biasing mechanism. The detent biasing mechanism may be based on a spring having grooves that interact with a protrusion on the shaft or a spring-loaded pin that engages recesses in the shaft. A switch mechanism for the button may be formed using traces on the shaft, spring-type switch contacts, and other structures.

13 Claims, 19 Drawing Sheets

SLIDING BUTTON WITH ROTATING SHAFT

BACKGROUND

This relates generally to sliding buttons, and more particularly, to sliding buttons with rotating shafts.

Electronic devices such as handheld electronic devices often include buttons. For example, a cellular telephone may have a button that slides between different positions. Conventional sliding buttons have button members that interact with a sliding switch. A user can slide a button member between different positions to actuate the sliding switch.

Conventional sliding button arrangements such as these may be difficult to manufacture with desired properties. In some arrangements, the proximity of the sliding button and the sliding switch mechanism make it difficult to mount a conventional sliding button within a device. Problems can also arise in switch placement and performance.

It would therefore be desirable to provide improved sliding buttons for use in equipment such as handheld devices and other electronic devices.

SUMMARY

An electronic device such as a cellular telephone, media player, portable computer, or other device may have a housing with an opening. A button may be formed within the electronic device. The button may have a button member. The button member may translate within the opening in the electronic device housing when actuated by a user. The button may have an open position and a closed position or may have three or more different positions. A switch mechanism within the button may have switch terminals. Different respective sets of the terminals may be electrically connected to each other in each of the button positions. Detents may be provided for each button position using a detent biasing mechanism.

The button may have a shaft that is coupled to the button member by a coupling mechanism. When the button member is laterally translated within the opening, the coupling mechanism may rotate the shaft about its longitudinal axis. The coupling mechanism may be formed by an engagement feature on the shaft that engages with an engagement feature on the button member. With one arrangement, a protrusion on the end of the shaft fits within an oval-shaped recess in the button member. With another arrangement, a portion of the button member is received within a groove in the shaft.

The button may be provided with detents using a detent biasing mechanism. The detent biasing mechanism may be based on a spring having grooves that interact with a protrusion on the shaft or a spring-loaded pin that engages recesses in the shaft.

The switch mechanism for the button may be formed using patterned conductive traces on the shaft. If desired, the shaft can be formed from metal or other conductive material and can be used as part of the switch. Switch contacts may be mounted to the housing of the electronic device or to a shaft support member. Spring-type switch contacts, switch contacts formed from spring-loaded pins, and other switch terminals may be used in the switch. Switch terminals may be formed as an integral portion of the detent biasing mechanism or as separate structures.

The button may use a coupling mechanism that converts lateral button member movement into longitudinal movement of the shaft. The shaft may have a groove that interacts with a protrusion on the button member. When the button member is translated, the protrusion on the button member may move within the groove and push the shaft along its longitudinal axis. A dome switch or other switch mechanism may be formed at one end of the shaft. When the shaft moves along its longitudinal axis, the switch may be actuated.

Further features of the invention, its nature and various advantages will be more apparent from the accompanying drawings and the following detailed description of the preferred embodiments.

DETAILED DESCRIPTION

Sliding buttons may be used to control the operation of electronic devices. Examples of device functions that may be controlled using sliding buttons include power functions, media playback functions, functions associated with turning on and off a ringer (e.g., in a cellular telephone), and functions associated with controlling other components and device operations. A sliding button may be implemented using a momentary mechanism in which the button is automatically returned to a home position following movement to an actuated position. A sliding button may also be provided with detents that allow the button to be more permanently slid into a number of different positions. For example, a sliding button may be moved between a closed position and an open position each of which has a respective detent. A sliding button may also be provided with three or more detents each of which is associated with closing a circuit between a different respective pair of button terminals.

The devices in which sliding buttons are used may, for example, be desktop computers, televisions, or other consumer electronics equipment. The electronic devices may also be portable electronic devices such as laptop computers and tablet computers. If desired, portable electronic devices may be somewhat smaller devices. Examples of smaller portable electronic devices include wrist-watch devices, pendant devices, headphone and earpiece devices, and other wearable and miniature devices. With one suitable arrangement, the portable electronic devices may be handheld electronic devices such as cellular telephones and media players.

Figure 1:
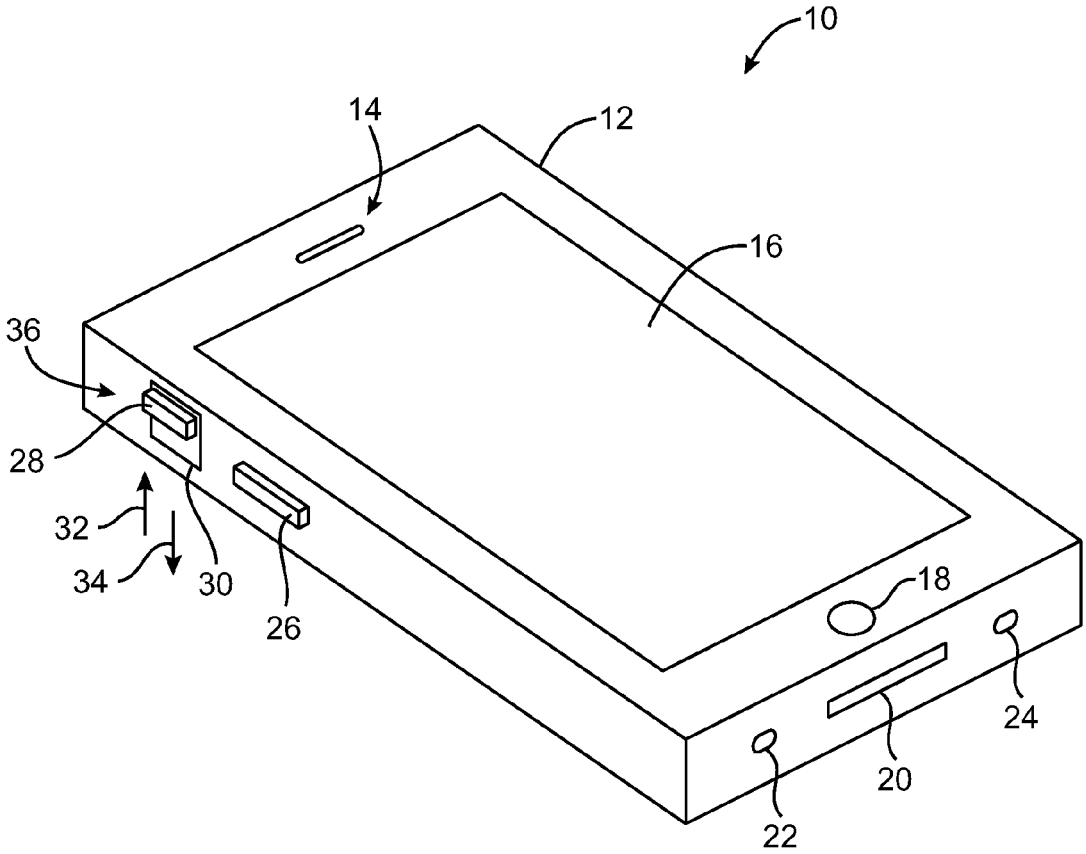
FIG. 1 is a perspective view of an illustrative electronic device that includes a sliding button in accordance with an embodiment of the present invention.

An illustrative electronic device of the type that may have a sliding button is shown in FIG. 1. Device 10 of FIG. 1 may be, for example, a handheld electronic device such as a cellular telephone with circuitry that runs email and other communications applications, web browsing applications, media playback applications, games, etc.

Device 10 may have housing 12. Housing 12 may be formed of materials such as plastic, glass, ceramics, metal, carbon fiber composites and other composite materials, other suitable materials, or a combination of these materials. Housing 12 may be formed using a unibody construction in which most or all of the exterior of housing 12 and at least some of its interior structures are formed from a single piece of material (e.g., molded plastic, machined metal, cast or stamped metal with machined surfaces, etc.). Housing 12 may also be formed using a multi-piece construction in which portions of the housing are formed from separate parts (e.g., housing side walls, a rear housing surface, internal supports and frame structures, etc.).

Display 16 may be mounted on the front surface of device 10 and may, if desired, be surrounded by peripheral structures such as a bezel. Speaker port 14 may be used to form an ear speaker for a user of device 10. Speaker and microphone ports 22 and 24 may be provided adjacent to data input-output port 20. Port 20 may receive a connector (e.g., a 30-pin connector).

Button 18 may serve as a menu button. Device 10 may be provided with additional buttons such as rocker button 26. One or more sliding buttons such as sliding button 36 may be used to control the operation of device 10. In the example of FIG. 1, sliding button 36 is provided along the left edge of device housing 12. This is merely illustrative. Sliding buttons such as sliding button 36 may be mounted on any suitable portion of an electronic device.

Sliding button 36 may have a sliding button member such as sliding button member 28. A user may control button 36 by sliding member 28 in directions 32 and 34. Housing 12 may have an opening such as opening 30 that allows button member 28 to travel in directions 32 and 34. When pressed upwards in direction 32, button member 28 will slide upwards within opening 30 into a first position such as the position shown in FIG. 1. When pressed downwards in direction 34, button member 28 will move downwards into a second position. Arrangements that support three or more positions may also be used for sliding button 36 if desired. Two-position arrangements are sometimes described as examples, but this is merely illustrative.

Figure 2:
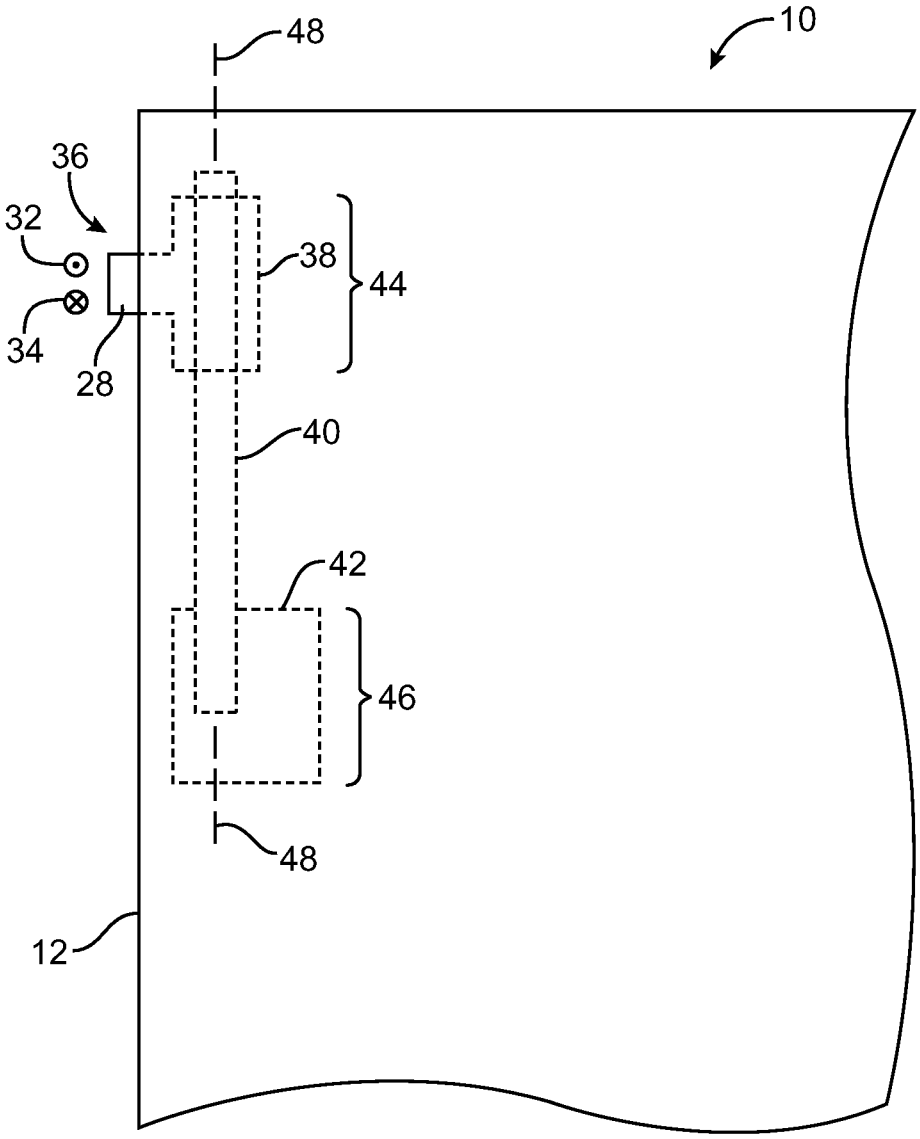
FIG. 2 is a top view of a portion of an illustrative electronic device showing how a sliding button may have a rotating shaft in accordance with an embodiment of the present invention.

FIG. 2 is a top view of a portion of device 10 and device housing 12 of FIG. 1 in the vicinity of sliding button 36. As shown in FIG. 2, button 36 may have a rotating shaft such as shaft 40. Button member 28 may be coupled to shaft 40 using coupling mechanism 38. Coupling mechanism 38 may be located at end 44 of shaft 40 (as an example). At other portions of shaft 40 such as at the other end of shaft 40 (i.e., at end 46), shaft 40 may be coupled to switch 42. As shown in FIG. 2, housing 12 may have a planar exterior housing surface and shaft 40 may be parallel to the planar exterior housing surface.

When a user slides button member 28 up and down in directions 32 and 34 (i.e., along an axis that runs parallel to directions 32 and 34), coupling mechanism 38 imparts rotational motion to shaft 40 about longitudinal axis 48 (which is orthogonal to the lateral translation axis of button member 28). The rotation of shaft 40 causes switch 42 to selectively open and close electrical circuits between two or more switch terminals. For example, in a two-position button arrangement, movement of button member 28 in a first direction (e.g., upwards in direction 32) will cause shaft 40 to rotate in a first direction until switch 42 has a first state (e.g., until switch 42 is closed) and movement of button member 28 in a second direction (e.g., downwards in direction 34) will cause shaft 40 to rotate in a second direction (opposite to the first direction) until switch 42 has a second state that is different than the first state (e.g., until switch 42 is open).

In this example, switch 42 and therefore button 36 has two positions (open and closed). This is merely illustrative. Switch 42 and button 36 may have any suitable number of positions. In arrangements with additional button positions, button member 28 may be placed in one or more intermediate locations and switch 42 can exhibit a correspondingly increased number of discrete states. The status of switch 42 can be conveyed using an appropriate number of switch terminals. For example, a three position switch may convey its state by shorting a connection between first and second terminals (in a first position), first and third terminals (in a second position), and first and fourth terminals (in a third position). Switches and buttons with different numbers of terminals and different terminal patterns may be used if desired.

To provide a user with tactile feedback, it may be desirable to provide button 36 with detents. These detents may be associated with respective states of switch 42. For example, if switch 42 is a two position switch, button 36 may be provided with two detents each of which corresponds to one of the two positions of switch 42 and one of the two corresponding positions of button member 28. If switch 42 is a three position switch, three detents may be provided, etc.

Detents may be provided using detent biasing mechanisms such as spring-loaded pins that bear against recesses in shaft 40 or that bear against other engagement features that move with shaft 40. Springs and other detent biasing structures may also be used in implementing detents. If desired, multiple detent mechanisms may be used (e.g., springs and spring-loaded pins).

The switch functionality of switch 42 may be provided using dome switches or other suitable switch mechanisms. Dome switches may have flexible dome members (e.g., plastic members with interior metal layers) that can be compressed to close a circuit between two substrate-mounted switch terminals. A dome switch may be mounted on a substrate such as a plastic member or a printed circuit board (e.g., a rigid printed circuit board, a flexible printed circuit board, or rigid flex). Dome switches may also be encased in switch housings to form tactile ("tact") switches.

Arrangements of the type shown in FIG. 2 in which button 36 includes a rotating shaft may help make it possible to optimize the placement of button 36. For example, button 36 may be mounted in a location with little housing depth. Shaft 40 may be compact relative to a switch, so the use of shaft 40 in the vicinity of button member 28 may help to make this portion of button 36 compact. Switch 42 and other potentially bulky portions of button 36 (e.g., a detent mechanism, switch terminals, mounting features, etc.) may be mounted in portions of a device with more available space (i.e., portions of a housing away from the immediate vicinity of button members 38). The use of shaft 40 may also make it possible to modify the mechanical advantage and tactile feel associated with actuating switch 42 and overcoming any associated detent resistance.

Shaft 40 may allow button member 28 and switch 42 to be located in a variety of different orientations, depending on packaging needs. The detent mechanism for button 36 and the switch mechanism for button 36 can be separated from the location at which button 36 is actuated by a user (i.e., button member 28). This flexibility in the placement of the components of button 36 may help overcome difficult packaging challenges and may simplify wire routing. By using mechanical advantage (e.g., by using smaller-radius and larger-radius structures on a common shaft 40), a long-travel can be constructed using a relatively small switch mechanism.

Figure 3:
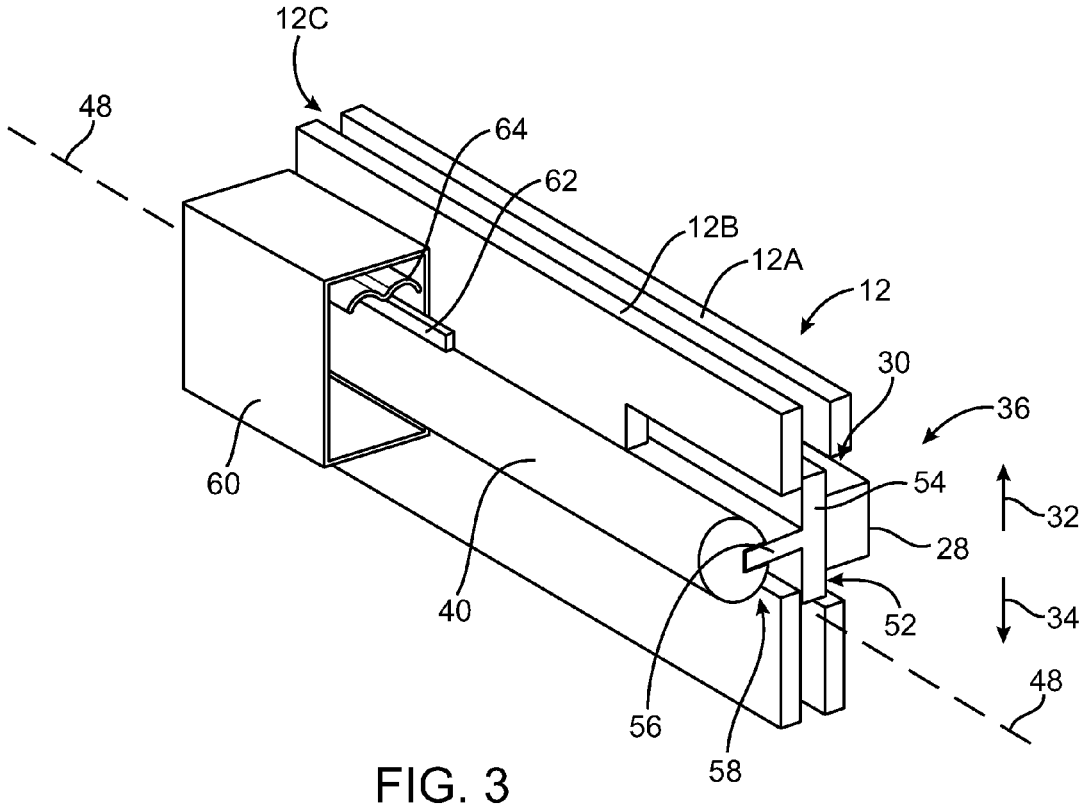
FIG. 3 is a perspective view of a sliding button having a rotating shaft in accordance with an embodiment of the present invention.

FIG. 3 is a perspective view of an illustrative embodiment of button 36. As shown in FIG. 3, button 36 may have a button member 28 that slides up in direction 32 and down in direction 34 relative to housing 12. Button member 28 may reciprocate within opening 30 in housing 12. Button member 28 and the other structures associated with device 10, housing 12, and button 36 may be formed from materials such as plastic, ceramic, glass, metal, composites, and combinations of such materials. For example, button member 28 and shaft 40 may (for example) be formed from metal.

Button member 28 may be mounted on a button member support such as support 52. Support 52 may have a first portion such as portion 54 that lies in the same plane as button member 28. Portion 54 may reciprocate (translate laterally) within gap 12C between outer planar housing portion 12A and inner planar housing portion 12B. Portion 56 of button member support 52 may have a tip portion that engages a mating groove in coupling portion 58 of shaft 40. In this embodiment of button 36, button support member 56 and the mating groove in shaft 40 serve as a coupling mechanism such as mechanism 38 of FIG. 2.

Button shaft support structures such as structure 60 may be used to mount shaft 40 within device 10. A spring such a spring 64 may have one or more grooves and one or more raised portions between the grooves. Each groove in spring 64 may correspond to a detent for button 36. As shaft 40 rotates about axis 48 in response to movement of button member 28, protrusion 62 deforms spring 64 and, while spring 64 is deformed, passes from one groove to the next.

Springs in button shaft support structures such as structure 60 and mating protrusions on shaft 40 are merely one illustrative type of biasing arrangement that may be used in forming button detent mechanisms. Other types of biasing structures that may be used include spring-loaded pins, friction bearings, etc. These biasing mechanisms may be formed as part of the support structures that hold shaft 40 in place, as part of switch 42, or as separate structures (as examples).

Figure 4:
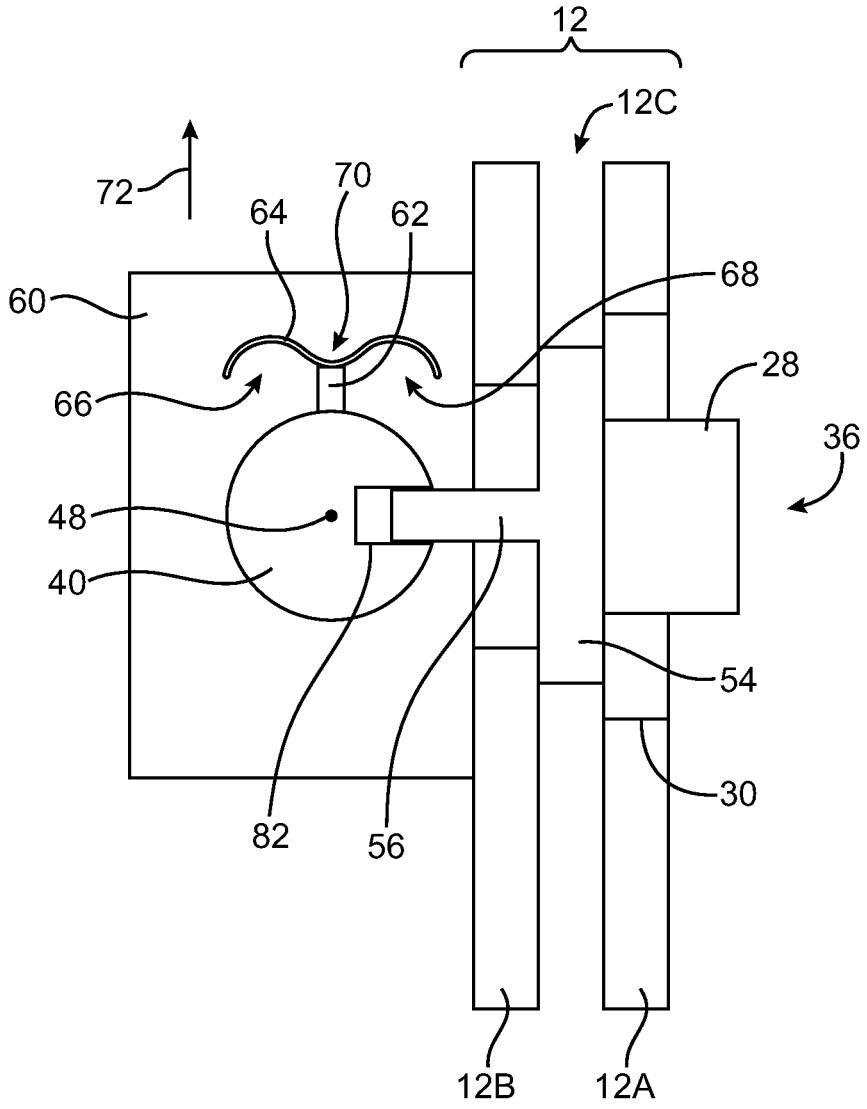
FIG. 4 is an end view of the sliding button of FIG. 3 in accordance with an embodiment of the present invention.

FIG. 4 is an end view of button 36 of FIG. 3. As shown in FIG. 4, spring 64 has two grooves (groove 66 and groove 68), each of which corresponds to a respective detent for button 36. In the position shown in FIG. 4, shaft 40 is midway between grooves 66 and 68 and is therefore in the act of compressing central portion 70 of spring 64 in direction 72.

Figure 5:
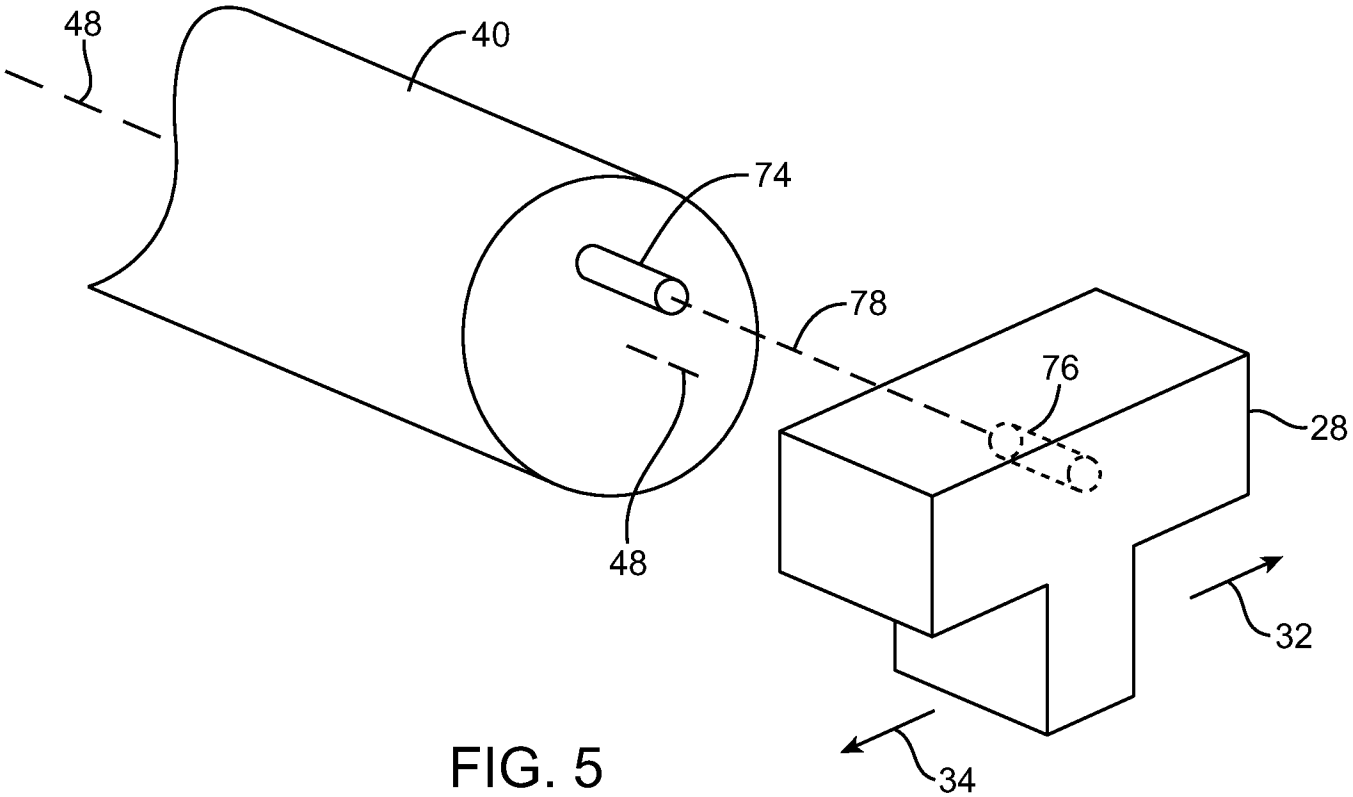
FIG. 5 is an exploded perspective view of showing how a longitudinally protruding feature such as a coupling post may be used in coupling a rotating shaft to a sliding button member in accordance with an embodiment of the present invention.

Coupling mechanisms such as coupling mechanism 38 may be implemented using a button structure such as structure 56 of FIG. 4 that is inserted into groove 82 in shaft 40. Another illustrative coupling mechanism arrangement is shown in FIG. 5. With an arrangement of the type shown in FIG. 5, shaft 40 has protrusion 74. The drawing of FIG. 5 is an exploded perspective view. When assembled to form a completed version of button 36, protrusion 74 on the end of shaft 40 mates with recess 76 in button member 28 (as indicated by dashed line 78). If button member 28 is moved in direction 32, shaft 40 will rotate clockwise about axis 48. Movement of button member 28 in direction 34 will cause shaft 40 to rotate in a counterclockwise direction about axis 48. If desired, other types of engagement features may be used to couple shaft 40 to button member 36. For example, protrusion 74 may be formed on button member 28 and mating opening 76 may be formed in shaft 40 (or a structure associated with shaft 40). The use of a mating protrusion and mating recess in coupling mechanism 38 of FIG. 5 is merely illustrative.

Figure 6:
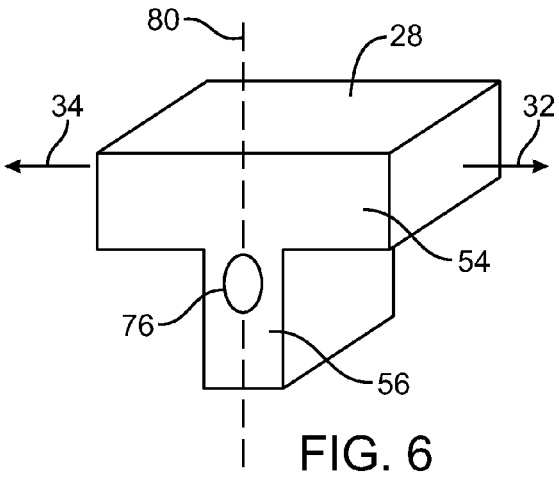
FIG. 6 is a perspective view of an illustrative button member having a coupling recess that is located on a vertical portion of the button member in accordance with an embodiment of the present invention.
Figure 7:
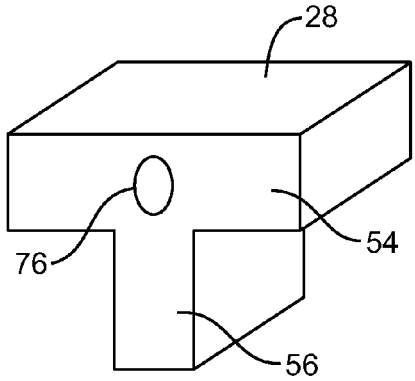
FIG. 7 is a perspective view of an illustrative button member having a coupling recess that is located on a horizontal portion of the button member in accordance with an embodiment of the present invention.

FIG. 6 shows how recess 76 may have an oval cross-sectional shape to accommodate movement of protrusion 74 parallel to axis 80 (e.g., a vertical axis) as button member 28 moves along orthogonal directions 32 and 34 (e.g., along a horizontal axis). In the example of FIG. 6, oval recess 76 is located on vertical member 56. If desired, recess 76 may be located on horizontal button member portion 54, as shown in FIG. 7.

Figure 8:
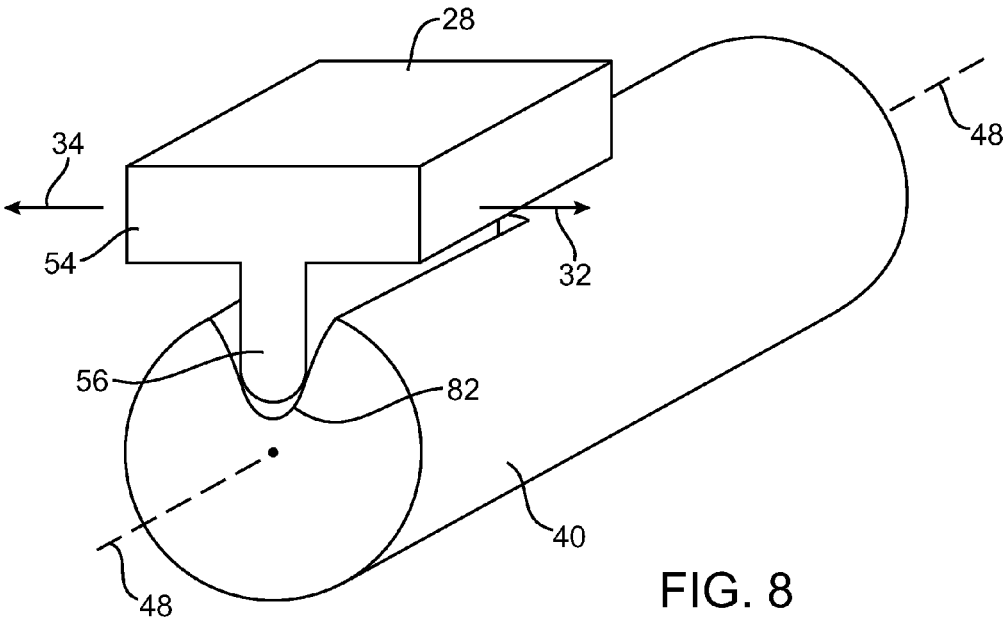
FIG. 8 is a perspective view of an illustrative button member having a rounded structure that mates with a corresponding recess in a rotating shaft in accordance with an embodiment of the present invention.

FIG. 8 shows how the exposed tip of portion 56 of button member 28 may be provided with a rounded surface and how groove 82 in shaft 40 may be provided with rounded sidewalls. Smoothed features such as these may help lateral movements of button member 28 in directions 32 and 34 to be smoothly translated into rotational movement of shaft 40 about axis 48.

Figure 9:
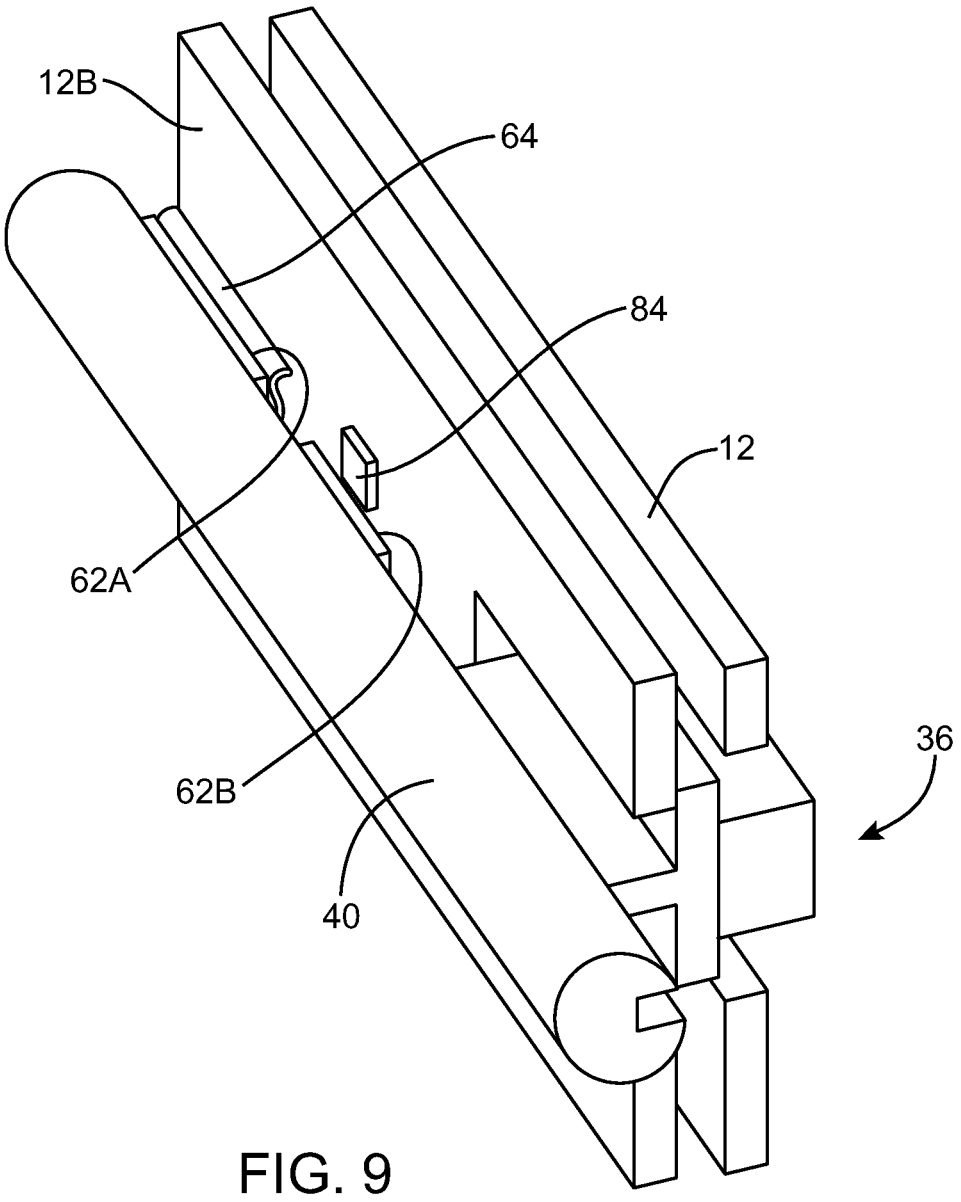
FIG. 9 is a perspective view of an illustrative button with a rotating shaft and an electrical contact formed on a housing structure in accordance with an embodiment of the present invention.

As shown in FIG. 9, spring 64 may be mounted on the inner surface of housing wall 12B (e.g., using adhesive, welds, fasteners, etc.). Shaft 40 may have a protrusion such as protrusion 62A that engages with mating grooves in spring 64. If desired, switch terminals for button 36 can be formed within separate dome switches. Switch terminals can also be formed from contacts that mate directly with conductive portions of shaft 40 or other rotating conductive members. For example, shaft 40 may have one or more protrusions such as protrusion 62B that are used to form electrical connection with switch terminals such as switch terminal 84. Switch terminals such as switch terminal 84 may be mounted on housing 12B or other suitable support structures. If desired, switch terminals may be formed from portions of detent springs such as spring 64.

Figure 10:
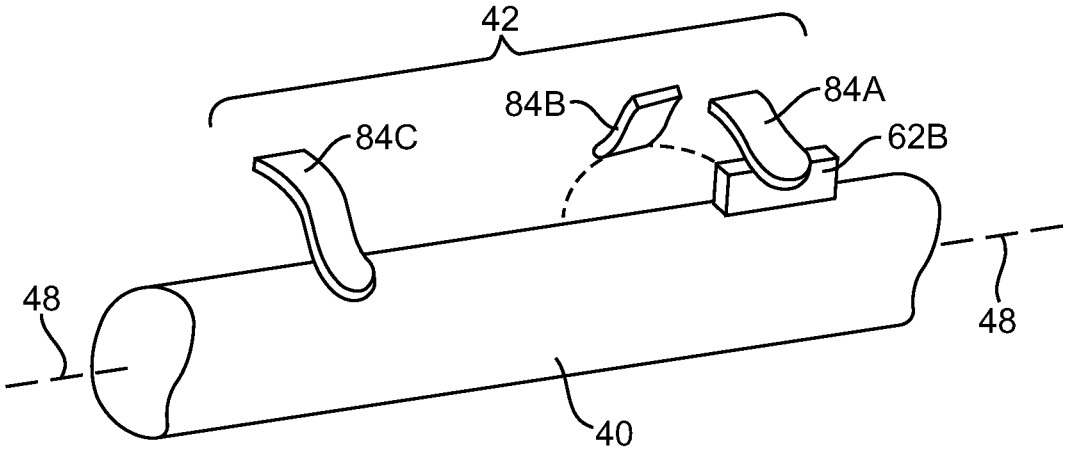
FIG. 10 is a perspective view of a portion of a sliding button showing how springs that bear against a rotating shaft may be used to form button terminals in accordance with an embodiment of the present invention.

FIG. 10 is a perspective view showing how switch 42 may have three switch terminals. Switch terminal 84C may be formed from a conductive member that is in continuous contact with the outer conductive surface of shaft 40. Shaft 40 may, for example, be formed from a solid metal rod, a rod that is coated with a blanket layer of metal or patterned metal traces, etc. No matter which rotational orientation is given to shaft 40 about axis 48, switch contact 84C will remain electrically shorted to shaft 40. Switch contacts 84A and 84B may be mounted in device 10 so that either one or the other comes into contact with conductive protrusion 62B on shaft 40.

In the rotational orientation shown in FIG. 10, protrusion 62B and therefore shaft 40 is electrically shorted to switch terminal 84A. When rotated, protrusion 62B will no longer be in contact with switch terminal 84A, but will be shorted instead to switch contact 84B. This is shown in more detail in the end view of FIG. 11, which shows protrusion portion 64B of shaft 40 in contact with switch terminal 84A. Switch terminal 84B and (in dashed lines) the position of protrusion 64B when shaft 40 is rotated are also shown.

Figure 11:
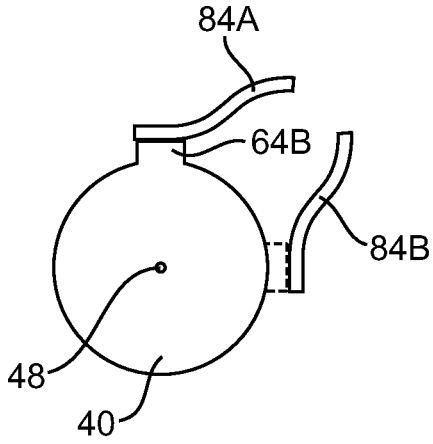
FIG. 11 is a cross-sectional end view of the sliding button of FIG. 10 showing how springs may be used to form button terminals in accordance with an embodiment of the present invention.

In switch arrangements of the type shown in FIGS. 10 and 11, current may pass through shaft 40 (as an example). In general, current may pass along the longitudinal axis of shaft 40 (e.g., current may pass through shaft 40, through a conductive trace on the surface of shaft 40, through a conductive within shaft 40, etc.). Any suitable number of switch terminals can be associated with the switch. The example of FIGS. 10 and 11 uses three terminals, but more than three terminals may be used if desired. Each switch position may have an associated detent (e.g., a detent provided by spring 64 (FIG. 9).

Figure 12:
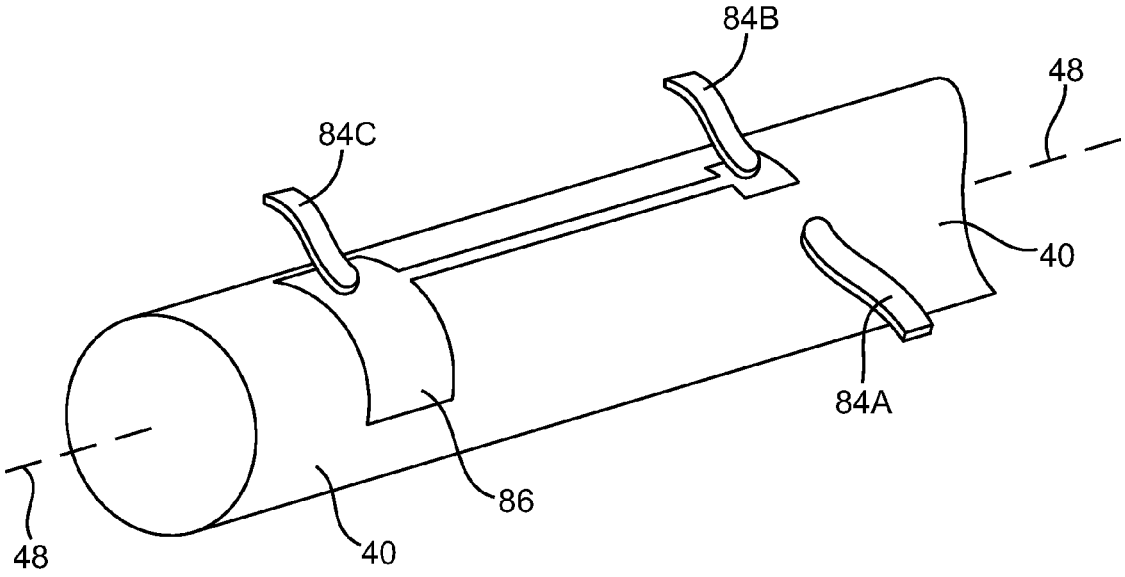
FIG. 12 is a perspective view of a rotating shaft in a sliding button showing how patterned traces on the rotating shaft may interact with springs that serve as button terminals in accordance with an embodiment of the present invention.
Figure 13:
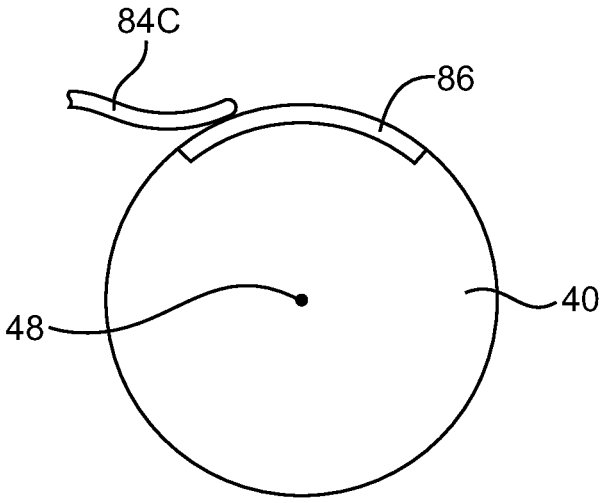
FIG. 13 is a cross-sectional end view of a button shaft showing how a spring may contact a conductor on the shaft when the shaft is rotated into a given position in accordance with an embodiment of the present invention.
Figure 14:
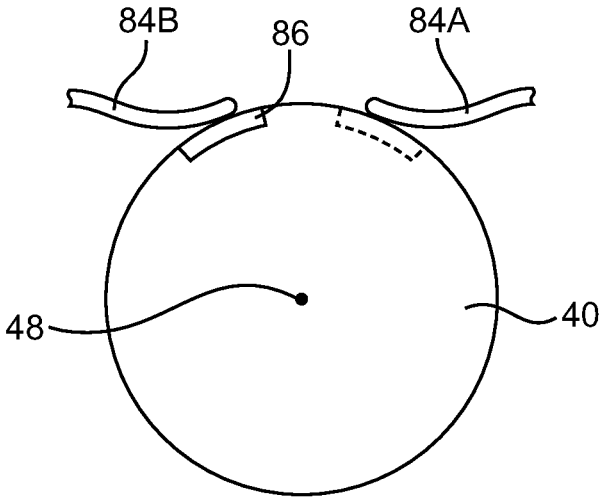
FIG. 14 is a cross-sectional end view of a button shaft showing how a pair of springs may selectively contact a conductor on the shaft depending on how the shaft is positioned in accordance with an embodiment of the present invention.

In the example of FIG. 12, conductive trace 86 has been formed on the surface of shaft 40. Shaft 40 may be formed from a dielectric or a conductive material. Trace 86 may be formed from metal (e.g., gold or copper plated with gold) or other suitable conductive materials. The shape of trace 86 may be adjusted to accommodate different types of locations for switch terminals 84A, 84B, and 84C. The end view of FIG. 13 shows how switch terminal 84C of FIG. 12 may be wide enough to remain in contact with trace 86 as shaft 40 is rotated between various switch positions. The end view of FIG. 14 shows how trace 86 of FIG. 12 may be rotated to be in contact with switch terminal 84B (as shown in FIG. 14) or switch terminal 84A (as illustrated by the dashed lines of FIG. 14).

Figure 15:
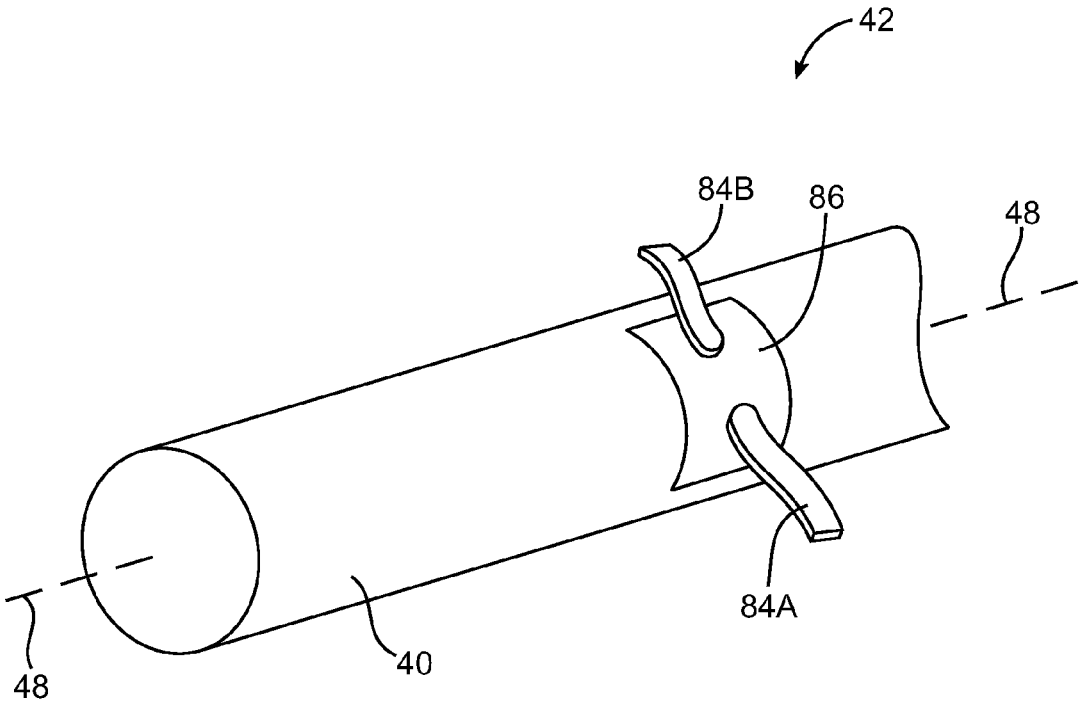
FIG. 15 is a perspective view of a rotating shaft in a sliding button showing how the shaft may be provided with a conductive structure that can be used to selectively short two button terminals together when the shaft is rotated into a given position in accordance with an embodiment of the present invention.
Figure 16:
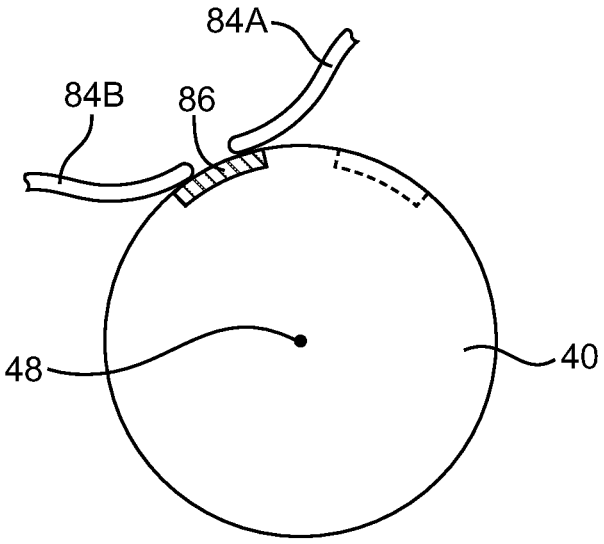
FIG. 16 is a cross-sectional end view of a rotating shaft of the type shown in FIG. 15 in accordance with an embodiment of the present invention.

With an arrangement of the type shown in FIG. 15, switch 42 may have a closed position when shaft 40 is rotated so that trace 86 connects switch terminals 84B and 84A (as shown in FIG. 15) and may have an open position when shaft 40 is rotated so that trace 86 does not electrically short terminals 84B and 84A. FIG. 16 is an end view of switch 42 of FIG. 15 showing how switch contacts 84B and 84A may be electrically connected through trace 86 and showing (by dashed lines) a position for trace 86 that will disconnect contacts 84B and 84A from each other to open switch 42. Contacts such as contacts 84A, 84B, and 84C may be formed from springs (e.g., using a spring metal).

Figure 17:
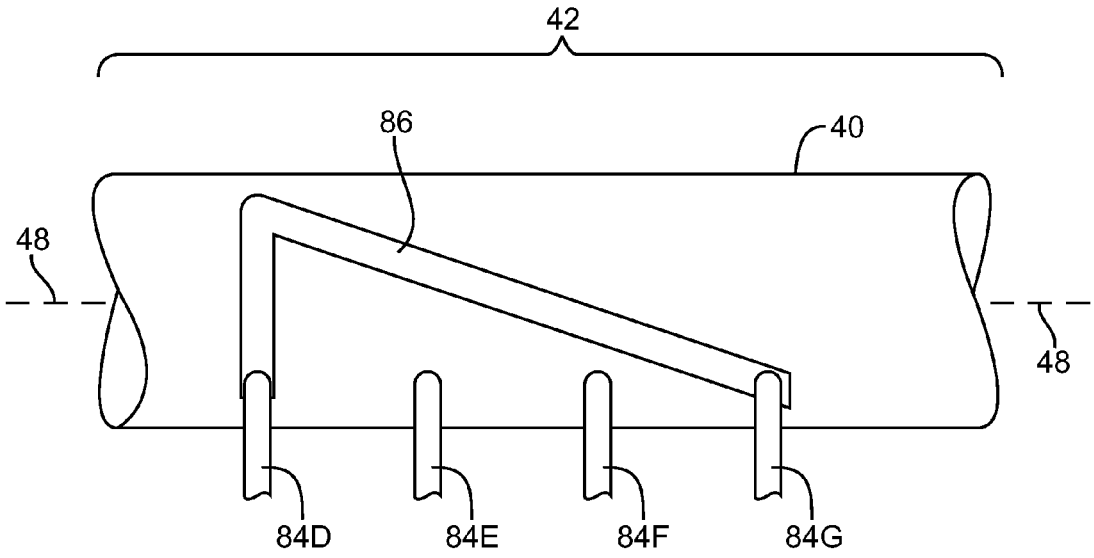
FIG. 17 is a side view of a rotating shaft with multiple button terminals in a sliding button in accordance with an embodiment of the present invention.

FIG. 17 shows how trace 86 may be angled relative to the terminals of switch 42 to implement a multi-position switch. Terminal 84D may stay in continuous contact with trace 86 on shaft 40. Shaft 40 may be rotated about axis 48 into three respective positions thereby shorting terminal 84D through trace 86 to contact 84G, 84F, or 84E, respectively.

Figure 18:
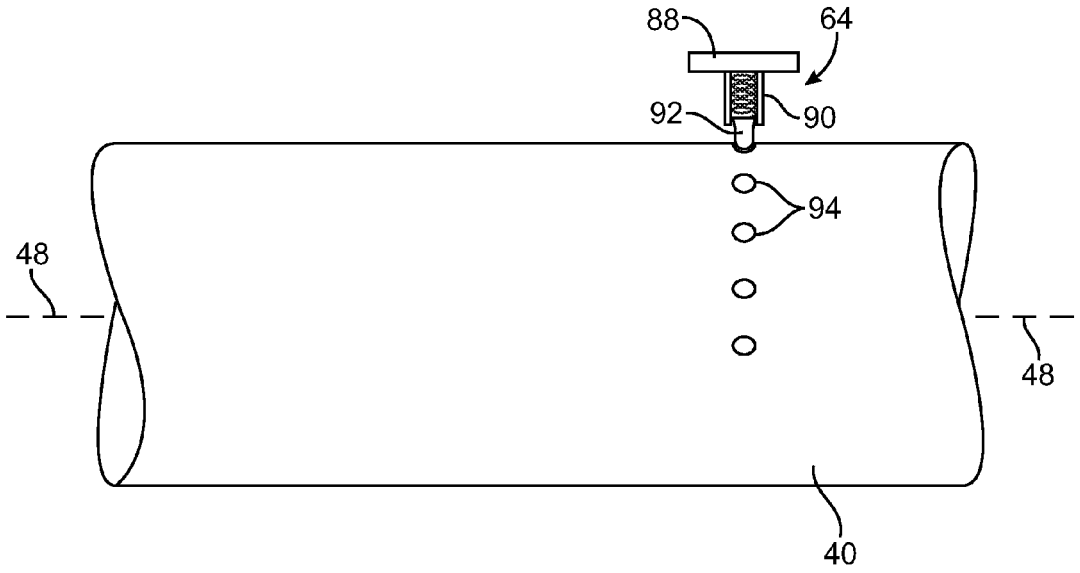
FIG. 18 is a side view of a rotating shaft in a sliding button showing how a spring-loaded pin that serves as a detent biasing structure may mate with features in a rotating shaft such as recesses to provide the button with detents in accordance with an embodiment of the present invention.

If desired, one or more spring-loaded pins such as pin 90 of FIG. 18 may be used to provide button 36 with detents. Pin 90 may be mounted to support 88 (e.g., a housing structure or other support member). A coil spring in pin 90 may bias spring tip 92 towards the surface of shaft 40. Shaft 40 may have holes 94 that mate with tip 92. Tip 92 and holes 94 may be rounded to facilitate movement of tip 92 into and out of each hole. For example, tip 92 may have a convex hemispherical shape and holes 94 may each have a concave hemispherical shape. Each hole 94 may correspond to a respective detent position for the rotation of shaft 40. If desired, traces (e.g., trace 86) may be extended into the holes and pins such as pin 90 may serve as switch contacts.

Figure 19:
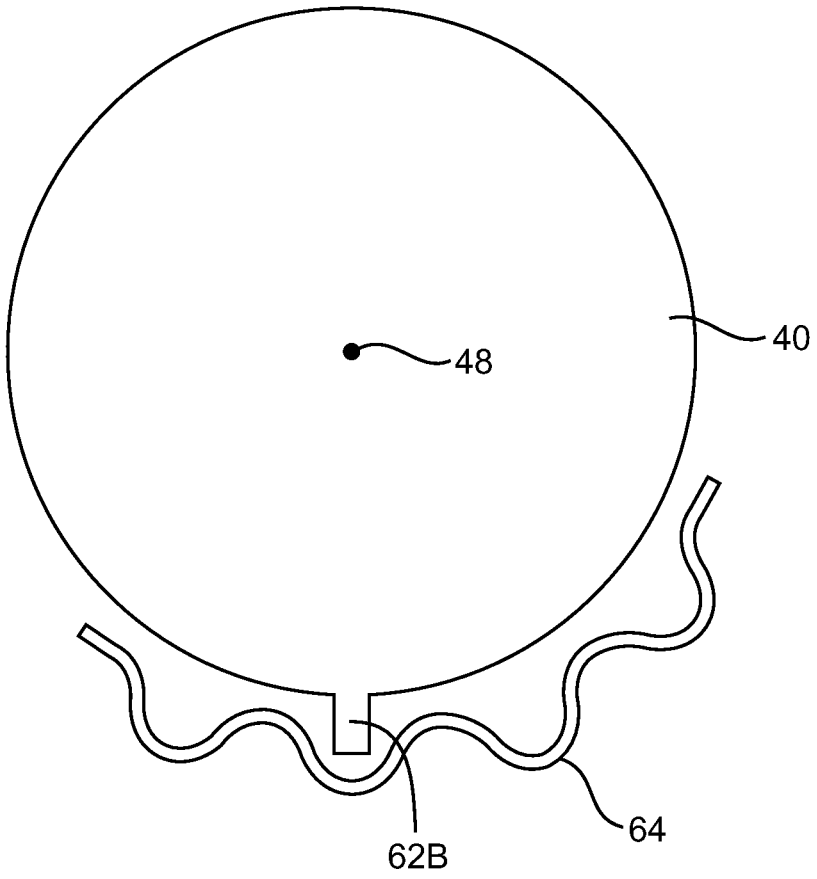
FIG. 19 is an end view of a rotating shaft in a sliding button showing how a spring may interact with a protrusion on a rotating shaft to provide the button with detents in accordance with an embodiment of the present invention.
Figure 20:
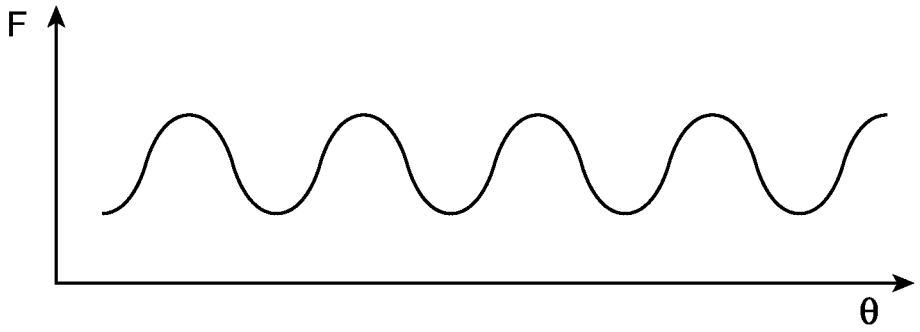
FIG. 20 is a graph showing how biasing structures such as the spring-loaded pin of FIG. 18 and the spring of FIG. 19 may impart different amounts of force on a button as a rotating shaft in the button rotates between different angular positions in accordance with an embodiment of the present invention.

If desired, spring biasing structures such as spring 64 of FIG. 9 and spring 64 of FIG. 3 may be provided with three or more grooves so that button 36 will have three or more corresponding detents. FIG. 19 is an end view of an illustrative configuration in which spring 64 has four grooves that can receive protrusion 62B on shaft 40. FIG. 20 is a corresponding plot of spring force as a function of angular rotation of shaft 40. Each time protrusion 62B is received within one of the grooves of spring 64 of FIG. 19, the force F of spring 64 on protrusion 62B is at a minimum (i.e., the button is in one of its detents). When protrusion 62B is in between the grooves of spring 64, force F is at a maximum. The graph of FIG. 20 also applies to the force exerted by other detent biasing mechanisms (e.g., the force exerted by pins such as spring-loaded pin 90).

Figure 21:
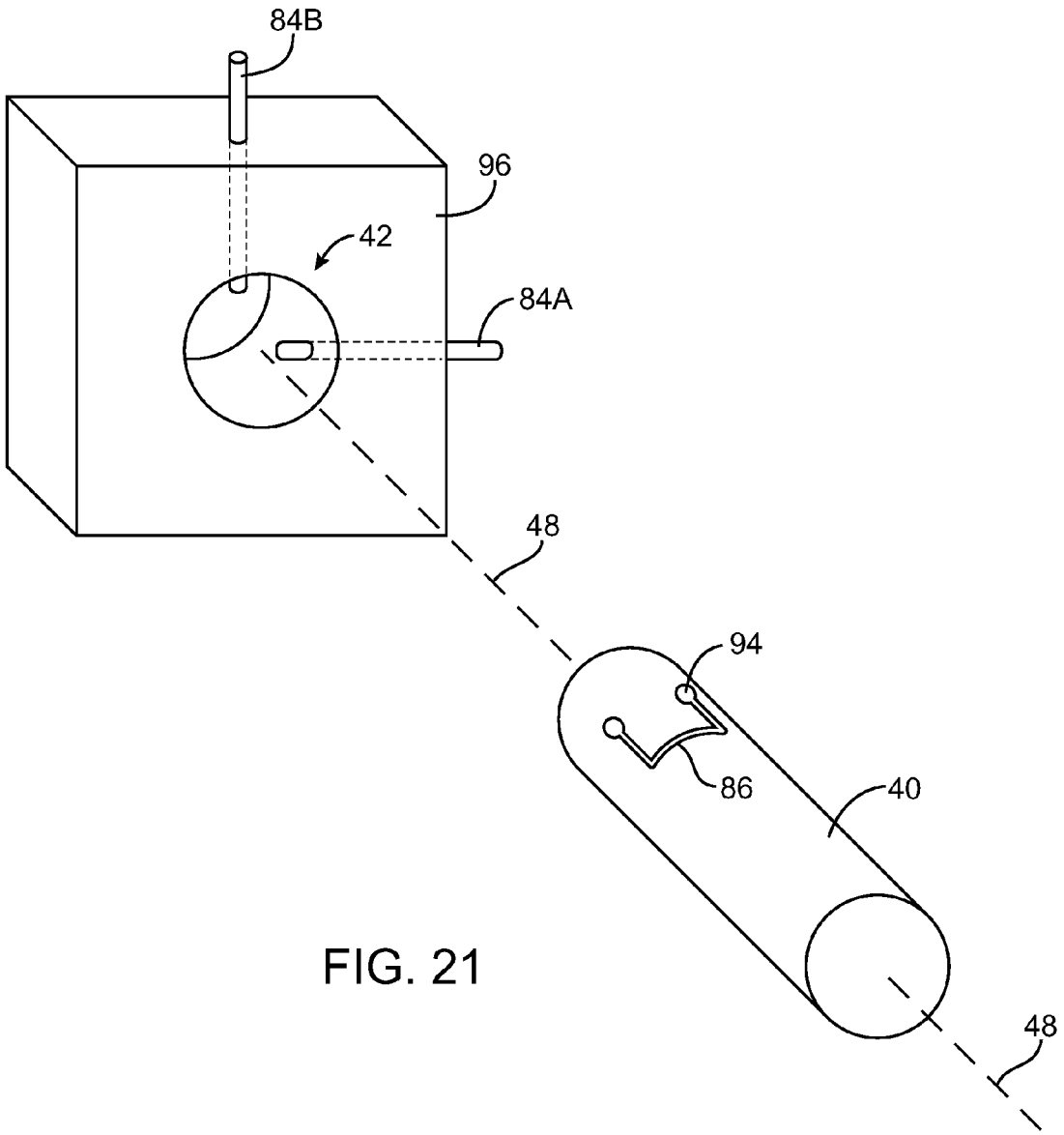
FIG. 21 is an exploded perspective view of a rotating shaft in a sliding button and a mounting structure that has structures that serve as button terminals and detent biasing structures in accordance with an embodiment of the present invention.

Shaft 40 may be supported by shaft support members such as shaft support member 96, shown in the exploded perspective view of FIG. 21. As shown in FIG. 21, shaft support member 96 may have an opening such as a cylindrical bore that receives shaft 40. Support members such as support member 96 may, for example, be formed from a dielectric such as plastic that is slippery enough to allow shaft 40 to rotate freely.

Switch 42 may be integrated into support 96. For example, conductive members 84B and 84A (e.g., spring-loaded pins or spring-shaped contacts) may form switch contacts and may mate with recesses 94 in shaft 40. Trace 86 may form an electrical path between recesses 94. When shaft 40 is rotated into place, switch contacts 84A and 84B will be shorted to each other and the switch will be closed. When shaft 40 is rotated further, switch contacts 84A and 84B will no longer both contact traces 86 and the switch will be opened. Spring-shaped switch contacts of the type shown in FIG. 12 may also be mounted to support structures such as structure 96 and may be used as switch terminals.

Figure 22:
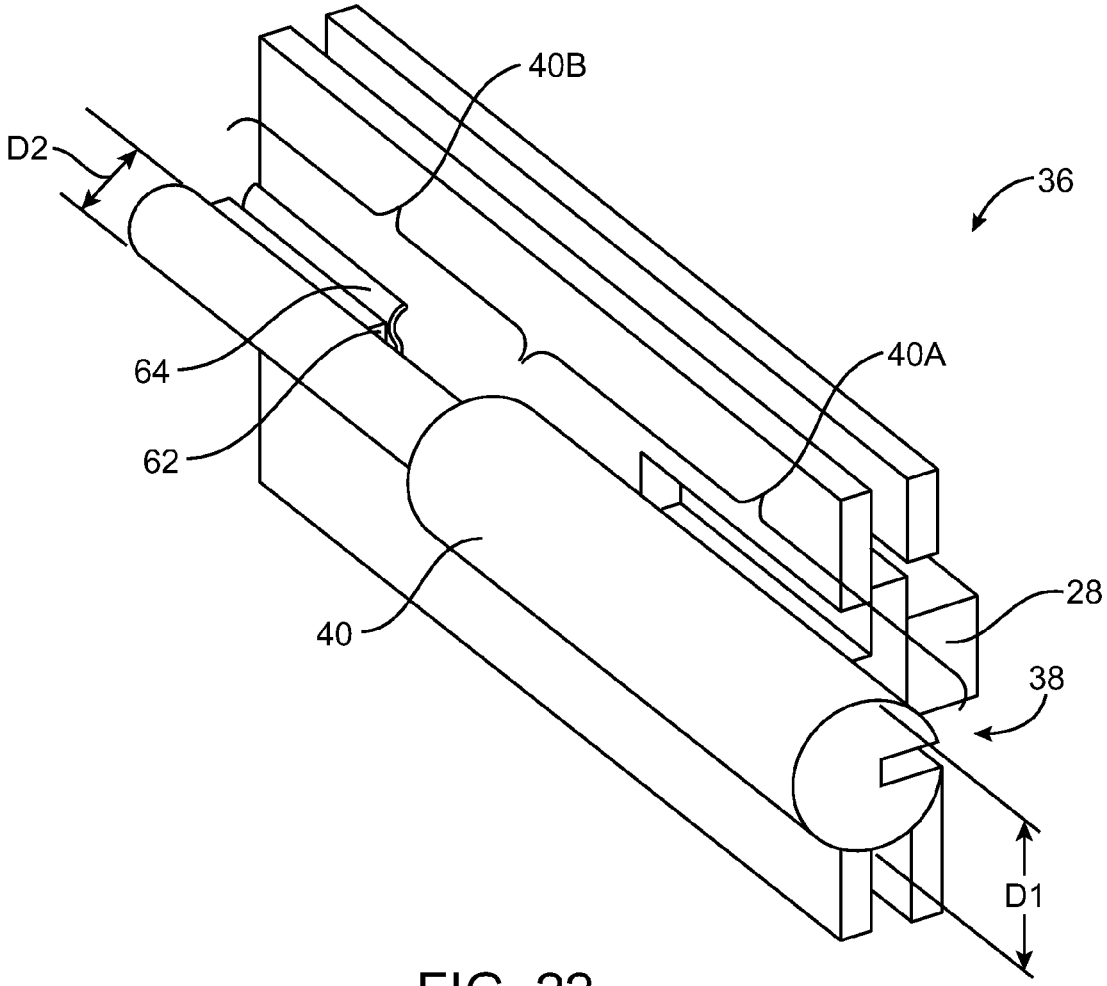
FIG. 22 is a perspective view of a rotating shaft in a sliding button showing how the shaft may be configured to produce a mechanical advantage in accordance with an embodiment of the present invention.

If desired, different sections of shaft 40 may be provided with different diameters to provide button 36 with mechanical advantage. As shown in FIG. 22, for example, portion 40A of shaft 40 may have diameter D1 and portion 40B of shaft 40 may have diameter D2. Button member 28 may mate with a groove in the portion of shaft 40 that has diameter D1 (i.e., to form coupling mechanism 38). Protrusion 62, which is used with spring 64 in forming a detent mechanism for button 36, may be formed on the portion of shaft 40 that has diameter D2. Because diameter D1 is larger than diameter D2, there is leverage (mechanical advantage) when using movement of button member 28 to move protrusion 62. This type of arrangement lessens the impact of variations in the biasing force provided by spring 64 on the forces experienced at button member 28. Accordingly, the use of mechanical advantage in the linking between button member 28 and detent biasing member 64 may help ensure that button 36 is manufactured within design tolerances and is provided with a desired amount of detent action. If desired, mechanical advantage may be provided with other configurations (e.g., using coupling mechanisms and protrusions of different sizes and shapes, etc.). The arrangement of FIG. 22 is merely illustrative.

Figure 23:
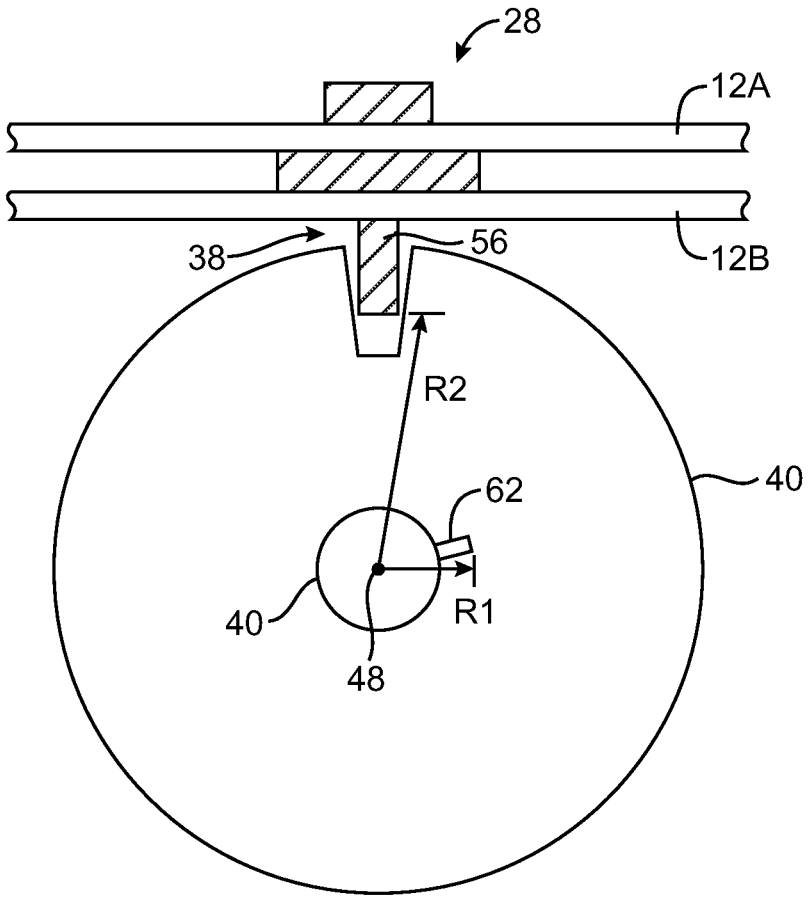
FIG. 23 is a cross-sectional end view of a portion of a rotating shaft of the type shown in FIG. 22 showing how a button member may be coupled to a recess in the shaft to impart rotational motion to the shaft in accordance with an embodiment of the present invention.
Figure 24:
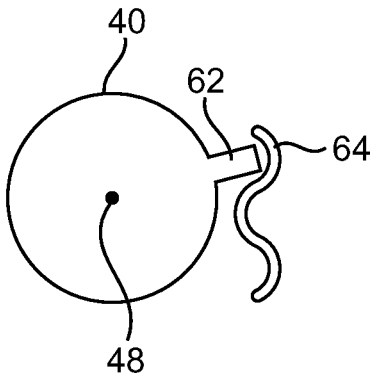
FIG. 24 is a cross-sectional end view of a portion of the shaft of FIG. 23 that has a reduced radius showing how the shaft may interact with a spring to provide a detent using mechanical advantage in accordance with an embodiment of the present invention.

FIG. 23 is an end view of an illustrative shaft that has mechanical advantage. As shown in FIG. 23, protrusion 62 may have a radius R1 from axis 48, whereas the location at which portion 56 of button member 28 bears against shaft 40 may have a radius R2 from axis 48. R2 is larger than R1, providing the button with mechanical advantage when converting translational motion of button member 28 into rotational motion of shaft 40 so that protrusion 62 interacts with spring 64 (FIG. 24).

Figure 25:
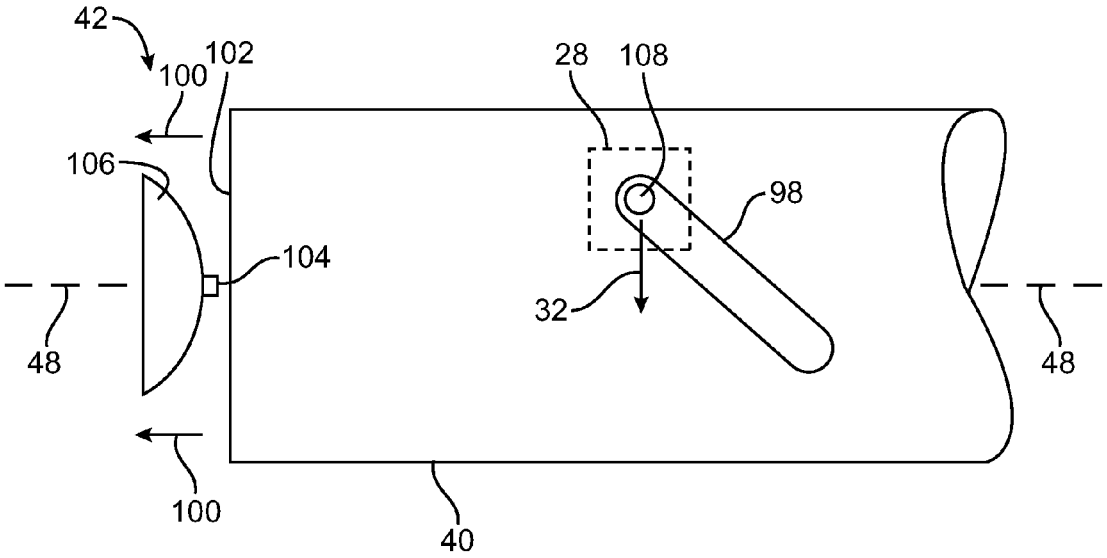
FIG. 25 is a side view of a sliding button showing how a rotating shaft in the button may be provided with a slot that converts sliding motion of a button member perpendicular to the shaft into lateral movement of the shaft along its longitudinal axis in accordance with an embodiment of the present invention.

If desired, shaft 40 may be provided with a groove or other feature that converts lateral button member motion into longitudinal shaft motion. This type of arrangement is shown in FIG. 25. As shown in FIG. 25, button member 28, which is shown by dashed lines, may have an inwardly protruding portion such as portion 108. Portion 108 may protrude into angled groove 98 in shaft 40. As button member 28 is translated laterally in direction 32 (i.e., transverse to longitudinal axis 48), portion 108 presses against the side walls of groove 98 and forces shaft 40 to move along longitudinal axis 48 in direction 100. This causes end surface 102 of shaft 40 to bear against tip 104 of dome switch 106, compressing and closing dome switch 106 (and thereby actuating switch 42). If desired, shaft 40 may be provided with protruding rings that engage grooves in springs or may be provided with ring-shaped recesses that engage inwardly protruding spring-loaded pins to implement detents. Switch contacts of the type shown in FIG. 12 may be formed by using a pattern of traces 86 on shaft 40 that open and close the switch in response to reciprocation of shaft 40 along longitudinal axis 48. Dome switch 106 of FIG. 25 may be mounted on a support member, may be implemented as a tact switch, etc.

The foregoing is merely illustrative of the principles of this invention and various modifications can be made by those skilled in the art without departing from the scope and spirit of the invention.

What is claimed is:

1. An electronic device button in an electronic device having a housing that defines an opening, the electronic device button comprising:

a sliding button member that is actuatable by a user along an actuation axis, the sliding button member comprising:

a movable portion positioned at least partially within the opening and operative to move along the actuation axis; and a coupling portion extending into the housing and connected to the movable portion:

a shaft within the housing comprising a conductive trace and defining a groove, the groove accepting and retaining the coupling portion of the button member, the shaft extending along a pivot axis perpendicular to the actuation axis and being rotatable about the pivot axis by translation of the movable portion at the button member along the actuation axis; and a switch comprising a plurality of switch contacts and at least a part of the switch contacts comprising the conductive trace, the switch having at least a first state and a second state and changeable from the first state to the second state by rotation of the shaft to a first angle;

wherein:

the conductive trace is angled with respect to the pivot axis; and the plurality of switch contacts are arranged to respectively contact the conductive trace as the shaft is rotated into different orientations about the pivot axis by translation of the movable portion of the button member along the actuation axis.

2. The electronic device button defined in claim 1 wherein the shaft is formed exclusively of conductive material.

3. The electronic device button defined in claim 1 further comprising a detent mechanism that provides the button with a plurality of detents.

4. The electronic device button defined in claim 3 wherein the detent mechanism comprises a spring with grooves and wherein the shaft has a protrusion that interacts with the spring.

5. The electronic device button defined in claim 3 wherein the detent mechanism comprises a spring-loaded pin and a plurality of recesses in the shaft that respectively engage the spring-loaded pin.

6. The electronic device button defined in claim 1 further comprising at least one shaft mounting structure having a pin that engages a recess in the shaft.

7. The electronic device button defined in claim 6 further comprising a patterned conductive trace on the shaft that is electrically shorted to the pin when the pin engages the recess.

8. The electronic device button defined in claim 1 further comprising a coupling mechanism that couples the sliding button member to the shaft.

9. The electronic device button defined in claim 8 wherein the coupling mechanism comprises a structure in the button member that protrudes into a corresponding groove in the shaft.

10. The electronic device button defined in claim 8 wherein the coupling mechanism comprises a first engagement feature on an end of the shaft that engages a second engagement feature on the button member.

11. The electronic device button defined in claim 10 wherein the first engagement feature comprises a protrusion on the end of the shaft and wherein the second engagement feature comprises a hole with an oval cross section in the button member.

12. The electronic device button defined in claim 1 wherein the shaft engages the button member at a first radius from the pivot axis, wherein the shaft engages a detent biasing structure at a second radius from the pivot axis, and wherein the first radius is larger than the second radius.

13. The electronic device button defined in claim 9 wherein the structure has a rounded surface and the corresponding groove has rounded sidewalls to facilitate lateral movement.

* * * * *